United States Patent [19]

Kim

[11] Patent Number: 4,716,059

[45] Date of Patent: Dec. 29, 1987

[54] COMPOSITES OF METAL WITH CARBON FLUORIDE AND METHOD OF PREPARATION

[75] Inventor: Jung T. Kim, Williamsville, N.Y.

[73] Assignee: Allied Corporation, Morris Township, Morris County, N.J.

[21] Appl. No.: 18,892

[22] Filed: Feb. 26, 1987

[51] Int. Cl.[4] ..... B05D 1/18

[52] U.S. Cl. ..... 427/443.1; 106/1.22; 106/1.23; 106/1.21

[58] Field of Search ..... 427/443.1 C; 106/1.22, 106/1.23, 1.26, 1.27

[56] References Cited

U.S. PATENT DOCUMENTS

| | | | |
|---|---|---|---|
| 3,617,363 | 11/1971 | Metzger et al. | 117/130 |
| 3,756,925 | 9/1973 | Takeuchi et al. | 204/16 |
| 3,787,294 | 1/1974 | Kurosaki et al. | 204/16 |
| 4,098,654 | 7/1978 | Helle et al. | 204/16 |
| 4,358,922 | 11/1982 | Feldstein | 427/443.1 C |
| 4,358,923 | 11/1982 | Feldstein | 427/443.1 C |

FOREIGN PATENT DOCUMENTS 3333121 3/1985 Fed. Rep. of Germany .

OTHER PUBLICATIONS

Feldstein et al., "The State of the Art in Electroless Composite Plating", The First AES Electroless Plating Symposium", Mar. 23-24, 1982, St. Louis, Mo., pp. 1-17.

Physical Chemistry of Surfaces, Arthur W. Adamson, 2nd ed., John Wiley & Sons, Inc. (1967), pp. 520-522.

*Primary Examiner*—Norman Morgenstern
*Assistant Examiner*—Vi D. Dang
*Attorney, Agent, or Firm*—Harold N. Wells; Jay P. Friedenson

[57] ABSTRACT

Carbon fluoride and metal are co-deposited from an electroless plating bath onto a suitable solid, forming a thin surface layer having low surface energy and good lubricity. Carbon fluoride particles having an average size from 0.2 to 8 μm are dispersed in an aqueous solution using 0.5 to 2 volume percent of surfactants comprising a nonionic surfactant having an HLB number of 10 to 20, optionally including up to a maximum 20% of a cationic surfactant based on the amount of nonionic surfactant used. Sufficient presuspended carbon fluoride particles are combined with an electroless metal plating bath to provide 1-50 grams of carbon fluoride per liter of the bath.

14 Claims, No Drawings

COMPOSITES OF METAL WITH CARBON FLUORIDE AND METHOD OF PREPARATION

DESCRIPTION

This invention relates to the preparation of composite materials in which a relatively dense surface layer is deposited on a solid object to provide self-lubrication and water repellency. More specifically, the invention comprises the co-depositing of carbon fluoride particles with metals from an electroless plating bath.

BACKGROUND OF THE INVENTION

Carbon fluoride as used in the present invention is to be distinguished from polymerized fluorinated hydrocarbons. The material itself is well known. It is formed by the reaction of carbon or graphite with fluorine or a fluorine compound at a relatively high temperature e.g. about 500° C. The product is a compound having a variable molar ratio of fluorine to carbon atoms and is sometimes characterized as having the formula $CF_x$. It is particularly useful because of its electrical insulating properties and its relatively inert character. It is not wetted by water and oil and consequently, repels those materials from a surface to which it has been applied. It also has self-lubricating properties at relatively high temperatures up to about 500° C. Consequently it is a very useful material for many applications such as pumps, molds for plastic parts, ball and butterfly valves for the oil and gas industries, carburetor choke shafts and the like.

Electroless deposition of metals from aqueous solutions is well known in the art. An example is electroless nickel plating, which is particularly useful in connection with the present invention. A plating bath of this type contains at least four ingredients, namely, a source of nickel ions, a hypophosphite compound as a reducing agent, an acid or hydroxide pH adjusting compound and a complexing agent for the metal ions to prevent their premature precipitation.

It would be desirable to use a single bath in order to deposit both carbon fluoride particles and metal in combination to provide the properties available from each. In U.S. Pat. No. 3,617,363 various wear reducing particles were added to an electroless plating bath in order to improve the properties of the resulting co-deposited surface. These particles included molybdenum disulfide and silicon carbide and various other materials such as kaolin, plastic resins, metal oxides and other compounds including fluorides of many metals. However, there is no suggestion that carbon fluoride was contemplated.

In U.S. Pat. No. 3,765,925 the use of carbon fluoride in a plating bath is disclosed. However, in this case the bath is formulated for electrolytic deposition and consequently the properties of the materials and the composition of the bath differ from those of the present invention. A number of dispersion promoting additives for the carbon fluoride are suggested. Typical additives were characterized as being water soluble high molecular weight compounds, water soluble organic solvents and colloidal oxides. There is no suggestion, however, of the materials used in the bath of the present invention. In the related U.S. Pat. No. 3,787,294, however, a combination of various surfactants was indicated to be useful in connection with an electrolytic as opposed to electroless plating bath for depositing carbon fluoride along with metal. The surfactants used in such bath were characterized as being selected from the group comprising cationic surfactants, nonionic surfactants and amphoteric surfactants which *exhibit cationic characteristics* at the pH value of the particular plating bath employed. It is evident from this disclosure that the characteristics of the electrolytic plating process are significantly different from those the present invention as will be seen in the disclosure below.

In U.S. Pat. No. 4,098,654 an electrolytic plating process is used to deposit polyfluorocarbon resin particles and metals together and in which both cationic and non-ionic fluorocarbon surfactants are employed.

In a recent disclosure in West German Published Application No. DE3333121, electroless deposition as well as electrolytic deposition of carbon fluoride along with metals is disclosed. From the material claimed it would appear that the method is primarily directed to the use of polytetrofluoroethylene and consequently, only to a secondary extent to carbon fluoride. Nevertheless, a significant difference exists between the method disclosed by the German applicants and that of the present invention since it appears that the cationic and non-ionic surfactants used are significantly different and in different proportions than those which are required by the present invention. Consequently, there is no suggestion of the important factors which have been found to pertain to the electroless plating of carbon fluoride and metals together.

SUMMARY OF THE INVENTION

The invention relates to electroless co-deposition of particulate carbon fluoride and metals from a unique plating bath and the coated products from such co-deposition, which have low surface energy and high lubricity.

The plating bath is prepared by first suspending carbon fluoride particles having an average size of 0.2 to 8 μm in an aqueous solution which includes about 0.5 to 2.0 percent by volume of a non-ionic surfactant having a Hydrophile-Lipophile Balance No. (HLB) of 10 to 20. A limited amount of a cationic surfactant has been found to increase the amount of carbon fluoride deposited and a maximum of about 20% based on the amount of non-ionic surfactant is used. The presuspended carbon fluoride particles are added to an otherwise conventional electroless metal plating bath. Particularly preferred is an aqueous bath containing nickel compounds. The amount of carbon fluoride in the plating bath is generally the range of 1 to 50 grams per liter.

A solid to be plated is suspended in the bath for a suitable period of time, say one hour, until a surface layer of co-deposited carbon fluoride and metal of the desired thickness has been achieved. Typically, the surface layer may be 12 to 22 μm thick and contain up to 30% carbon fluoride. The surface energy of the surface layer may be 48.7 to 25.8 dynes/cm, which indicates its ability to repel water. In addition, it has good self-lubricating properties.

DESCRIPTION OF THE PREFERRED EMBODIMENTS

The co-deposition of carbon fluoride and a metal from an electroless plating bath can be done according to the invention within certain defined parameters, outside of which the process is unsatisfactory or unworkable.

The carbon fluoride ($CF_x$) is a material known in the art as previously indicated. A representative material is ACCUFLUOR ®$CF_x$ available from Allied-Signal Inc. The composition of such compounds vary. The value of x may be between 0.01 to 1.25, but greater than 0.9 is preferred. The average particle size has been found to be important. It may range between about 0.2 and 8 μm. Particularly, an average particle size below 3 μm is preferred. As will be seen in Example 4 below, with suitable amounts of non-ionic surfactants present, the carbon fluoride particles remain in suspension for extended periods, but above 8 μm average particle size the period is much reduced. Best results are found when the average particle size is below about 3 μm.

Another important factor in the successful suspension of carbon fluoride is the type and amount of the surfactants which are used. It bas been found that cationic and anionic surfactants are not useful alone, as the experiment described in Example 5 below shows. However, it has been found that small amounts of cationic surfactants can be used to increase the amount of carbon fluoride deposited relative to the metal. When so used, it should be limited to no more than about 20 volume percent relative to the non-ionic surfactant.

The surfactant should be non-ionic in character, but contrary to suggestions in the art that fluorocarbon surfactants are useful, the present invention uses non-ionic surfactants which are defined by an HLB No. (Hydrophile-Lipophile balance number). Fluorocarbon surfactants are not so characterized and therefore are excluded from the invention. Preferred surfactants are those represented by the formula

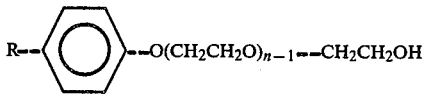

and available as Igepal ®CO from GAF Corp. Analogous or related materials such as Triton X-100 from Rohm and Haas Company may also be used. As will be seen in Example 6 below the balance of hydrophilic and lipophilic properties is important in providing stable suspensions of carbon fluoride in water. Below an HLB of 10 the suspension is poor, while a HLB of 10 to 20 gives a good suspension, i.e. carbon fluoride particles are not agglomerated or coagulated. The carbon particles are suspended in water using a suitable amount of surfactant. Typically, this will be in the range of about 0.5 to 2 volume percent based on the total solution volume. At least about 0.5% is needed to properly suspend the carbon fluoride particles. Above 2%, agglomeration of the particles increases and any sediment which forms is not easily redispersed. Preferably, about 1 volume percent of surfactant is used.

While a relatively high concentration of carbon fluoride particles in solution is desirable, nevertheless, a practical limit has been found. Above about 20% by weight, the solution become too viscous to be easily handled and mixed with the metal plating bath. Consequently, a solution containing less than 15% by weight carbon fluoride is preferred.

After the surfactant has been chosen, preparation of a stable suspension of carbon fluoride particles may be carried out in various types of commercially available equipment. Particularly useful is dispersing and grinding equipment which provides a narrow distribution of particle size. One procedure is described in connection with the examples below.

Once the carbon fluoride suspension has been prepared, it may be added to an electroless plating bath such as is known in the art. Composite layers may be precipitated from solutions of various metals including nickel, copper, cobalt and gold. Particularly useful is a bath containing nickel compounds since nickel provides superior performance in engineering applications. Such a bath will contain at least a source of nickel, a reducing agent, a pH adjusting compound, and a complexing agent for the nickel ions. Representative baths will be found in the examples which follow. Electroless plating has advantages over electrolytic plating when non-conducting substrates or those having complex shapes are to be plated.

The carbon fluoride suspension is added with mixing to the previously prepared plating bath until the desired concentration of carbon fluoride is attained. Generally, the concentration will be in the range of from 1 to 50 grams per liter. Preferably, a range of 10 to 30 g/l is used for many applications.

A substrate to be plated is immersed in the combined bath until the desired coating thickness has been obtained. Typically, for a thickness of about 17.5 μm, about 60 minutes is needed. The time will vary depending upon the desired thickness.

EXAMPLE 1

A suspension of carbon fluoride particles in water was prepared by adding 10 ml. of a non-ionic surfactant (Triton X-100 HLB 13.5 supplied by the Rohm and Haas Company) to one liter of distilled water and then adding 100 grams of carbon fluoride particles (Accufluor ®$CF_x$ Allied-Signal Inc.) having an average size of 3 μm with agitation for about one hour until the particles were uniformly suspended.

EXAMPLE 2

Another suspension was prepared according to the procedure of Example 1 except that the non-ionic surfactant was CO-720 supplied by GAF Corporation, having an HLB of 14.2.

EXAMPLE 3

The effectiveness of the non-ionic surfactant used in Examples 1 and 2 is shown by measuring the amount of sediment formed in a non-agitated container. Forty (40) ml of each suspension was poured into a graduated cylinder and the amount of sediment measured over a weeks time. It was found that about 80% remained in suspension after one week as defined by the following formula:

$$\% = \left[\frac{V_T - (V_S + V_C)}{V_T}\right] \times 100$$

where:

$V_T$=total volume of original sample
$V_S$=volume of sediment formed
$V_C$=volume of clear solution separated

EXAMPLE 4

The particle size must not be too large if the suspension is to remain stable and any sediment easily resuspended if necessary. A series of carbon fluoride samples were tested as described in Example 3, but the average size was varied. It was found that the maximum useful size was about 8 μm as shown by the results in the following table.

TABLE A

| $CF_x$ average particle size, μm | % in suspension after 1 day | after 1 week |
|---|---|---|
| 1.44 | 95.0 | 83.0 |
| 1.77 | 91.7 | 88.7 |
| 1.81 | 94.0 | 84.5 |
| 3.3 | 88.3 | 80.0 |
| 8.0 | 20.0 | 0–1 |

EXAMPLE 5

Comparative

It has been found that neither cationic nor anionic surfactants alone can be used to suspend carbon fluoride particles. Following the procedures of Example 1, 1 ml of an anionic surfactant (Nia proof®Anionic Surfactant supplied by Niacet Corp., Niagara Falls, NY) and 1 ml. of a cationic surfactant (FC-135 supplied by 3M Co., St. Paul, Minn.) were placed in a mixture of 100 ml. of distilled water and 10 ml. isopropyl alcohol. 10 grams of carbon fluoride (Accufluor®$CF_x$, average particle size 0.2 μm) was added with agitation. After two days the carbon fluoride particles were substantially all settled. In a similar composition using the Triton-X 100 used in Example 1 the carbon fluoride particles remained in suspension for more than a week.

EXAMPLE 6

Not all non-ionic surfactants are useful. It has been found that the Hydrophilic-Lipophilic balance number (HLB) must be in the range of about 10 to 20. Generally, in such a range the surfactants are water soluble. A series of suspensions were prepared with non-ionic surfactants having a range of HLB numbers. In each experiment 1 ml. of the surfactant was dissolved in 100 ml. of distilled water and 10 grams of carbon fluoride particles (ave. size 3 μm) were added with agitation. The results are shown in the following table

TABLE B

| Surfactant | HLB | Appearance | Suspension |
|---|---|---|---|
| CO-430 | 8.8 | Cloudy | Poor |
| CO-520 | 10.0 | Cloudy | Poor |
| CO-630 | 13.0 | Clear | Good |
| Triton X-100 | 13.5 | Clear | Good |
| CO-720 | 14.2 | Clear | Good |
| CO-730 | 15.0 | Clear | Good |
| CO-880 | 17.2 | Clear | Good |
| CA-887 | 17.4 | Clear | Good |
| CO-970 | 18.2 | Clear | Good |
| CO-990 | 19.0 | Clear | Good |

The general formula for the GAF Corp. surfactants is:

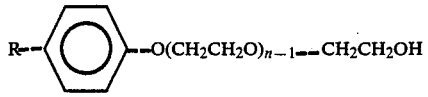

where $R=C_8H_{17}$ for CA series
where $R=C_9H_{19}$ for CO series

EXAMPLE 7

A nickel plating bath was used to demonstrate the invention having the following composition:

| Component | Concentration g/l water |
|---|---|
| Nickel sulfate ($NiSO_4.6H_2O$) | 25–30 |
| Sodium glycollate ($CH_2OHCOONa$) | 50–60 |
| Sodium hypophosphite ($NaH_2PO_2.H_2O$) | 20–30 |

The bath has a pH of 4–5 and is maintained at 85°–90° C.

Suspension of carbon fluoride (ave. size 8 μm) in water prepared as in Example 1 were added to the above plating bath to provide a carbon fluoride concentration of 33.3 g/l. A steel plate measuring 2.5 cm×2.5 cm×1 mm was immersed in the plating bath containing $CF_x$ for about 90 minutes until a coating about 25 μm had been deposited. The surface energy of the deposit was measured using a Goniometer Contact Angle instrument (Rame-Hart Inc., Mountain Lakes N.J.) and found to be 31.2 dynes/cm. For comparison water has a surface energy of 72 dynes/cm.

EXAMPLE 8

Example 7 is repeated except that the amount of $CF_x$ suspension is reduced to 6.6 g/l. The surface energy of the deposit was measured to be 37.4 dynes/cm.

EXAMPLE 9

Example 7 is repeated again with $CF_x$ suspension reduced to 2 g/l. The surface energy of the deposit was measured to be 48.7 dynes/cm. It will be seen by comparing Examples 7–9 that the surface energy is proportional to the concentration of $CF_x$ particles in the plating bath, indicating that the amount of $CF_x$ in the deposit is being changed.

EXAMPLE 10

Example 8 is repeated except that the average $CF_x$ particle size is 3 μm instead of 8 μm. The surface deposit is found to have a surface energy of 25.8 dynes/cm. instead of 37.4 dynes/cm., suggesting that the amount of $CF_x$ deposited is greater or more uniformly distributed.

EXAMPLE 11

A series of experiments was carried out to determine the amount of carbon fluoride co-deposited with the nickel. A suspension was prepared according to Example 2 except that the average $CF_x$ particle size was 3 μm instead of 8 μm to the nickel plating batch was added varying amounts of $CF_x$ suspension to provide a series of $CF_x$ concentrations. The amount of $CF_x$ in the deposit was measured by dissolving the nickel deposit in 40% by volume $HNO_3$ and filtering and weighing the $CF_x$ particles. The volume of $CF_x$ in the deposit was calculated as:

$$V(\%) = \left( \frac{\frac{\Delta W}{2.7}}{V_p} \right) \times 100$$

wherein
$V(\%)$=volume (percent) of $CF_x$
$V_p$=volume of the deposit
$\Delta W$=measured weight of $CF_x$
2.7=$CF_x$ density, g/cm$^3$ A titanium workpiece 5 cm.×6 cm.×0.1 mm was first coated with a nickel strike in Watt's nickel electroplating bath before co-depositing $CF_x$ nickel in the electroless bath. The results obtained are given in the following table.

TABLE C

| $CF_x$ conc. in bath, g/l | $CF_x$ in deposit vol. % |
|---|---|
| 3 | 3.2 |
| 5 | 3.4 |
| 10 | 5.2 |
| 20 | 9.6 |
| 30 | 12.2 |
| 40 | 12.0 |

EXAMPLE 12

The maximum amount deposited was 12.2% in the previous example. It has been found that the amount can be increased by adding a minor fraction of a cationic surfactant relative to the nonionic surfactant.

A suspension of $CF_x$ particles in water was prepared as in Example 2, except that 1.25 ml. of a cationic surfactant (FC-135 supplied by 3M Co., St. Paul, Minn.) was added and the $CF_x$ particle size was 3 μm instead of 8 μm. With this amount of cationic surfactant, the suspending power of the nonionic surfactant was not significantly impaired. Measurement of the amount of $CF_x$ in the deposit as before gave about 30% by volume at a $CF_x$ concentration of 20 g/l in the bath as compared with 9.6% in Table C above. The use of a minor fraction of cationic surfactant is advantageous, up to about a 20% based on the amount of nonionic surfactant used.

What is claimed is:

1. A process for the simultaneous electroless deposition of particulate carbon fluoride and metals comprising:

(a) suspending up to 20 wt. % carbon fluoride particles having an average particle size of 0.2 to 8 μm in an aqueous solution comprising,
  (1) about 0.5 to 2.0 % by volume of a non-ionic surfactant having an HLB number of 10 to 20, and optionally
  (2) up to about 20% by volume of a cationic surfactant relative to said non-ionic surfactant of (a) (1), (b) adding the suspension of carbon fluoride particles of (a) to an electroless metal plating bath;

(c) suspending a solid in the electroless metal plating bath containing suspended carbon fluoride particles for a period of time sufficient to co-deposit the desired amount of carbon fluoride and metal.

2. The process of claim 1 wherein said HLB number is 13 to 15.

3. The process of claim 1 wherein the carbon fluoride particles have an average particle size of less than 3 μm.

4. The process of claim 1 wherein the amount of carbon fluoride in the solution of (a) is from 1 g/l to 50 g/l.

5. The process of claim 1 wherein the total amount of non-ionic and cationic surfactants is about 0.5 to 2 volume %.

6. The process of claim 1 wherein the metal plating bath comprises an aqueous solution of compounds of at least one member of the group consisting of nickel, copper, cobalt and gold.

7. The process of claim 6 wherein said metal plating bath comprises an aqueous solution of a nickel compound.

8. An electroless plating bath comprising a mixture of:

(a) An aqueous suspension of carbon fluoride particles having an average particle size of 0.2 to 8 μm, said suspension comprising
  (1) about 0.5 to 2.0% by volume of a non-ionic surfactant having an HLB number of 10 to 20, and optionally
  (2) up to about 20% by volume of a cationic surfactant relative to said non-ionic surfactant of (a) (1);

(b) an electroless metal plating solution.

9. The plating bath of claim 8 wherein said HLB number is 13 to 15.

10. The plating bath of claim 8 wherein the carbon fluoride particles have an average particle size of less than 3 μm.

11. The plating bath of claim 8 wherein the amount of carbon fluoride is the suspension of (a) is from 1 g/l to 50 g/l.

12. The plating bath of claim 8 wherein the total amount of non-ionic and cationic surfactants is about 0.5 to 2 volume percent.

13. The plating bath of claim 8 wherein said electroless metal plating solution comprises an aqueous solution of compounds of at least one member of the group consisting of nickel, copper cobalt and gold.

14. The plating bath of claim 13 wherein said metal plating solution comprises an aqueous solution of a nickel compound.

* * * * *